US011688369B1

(12) United States Patent
Astfalk

(10) Patent No.: US 11,688,369 B1
(45) Date of Patent: Jun. 27, 2023

(54) ROCK BEND HARMONICA

(71) Applicant: Brian Astfalk, Tucson, AZ (US)

(72) Inventor: Brian Astfalk, Tucson, AZ (US)

(73) Assignee: Brian Astfalk, Tucson, AZ (US)

( * ) Notice: Subject to any disclaimer, the term of this patent is extended or adjusted under 35 U.S.C. 154(b) by 0 days.

(21) Appl. No.: 17/747,488

(22) Filed: May 18, 2022

(51) Int. Cl.
*G10D 7/14* (2020.01)

(52) U.S. Cl.
CPC ..... *G10D 7/14* (2020.02)

(58) Field of Classification Search
CPC ..... G10D 7/14
See application file for complete search history.

(56) References Cited

U.S. PATENT DOCUMENTS 364,610 A * 6/1887 Stratton ..... G10D 7/14 84/377
863,960 A * 8/1907 Yates ..... G10D 7/14 84/377
1,735,645 A * 11/1929 Hostetter ..... G10D 7/14 984/137
2,276,501 A * 3/1942 Manieri ..... G10D 7/14 84/377
2,511,302 A * 6/1950 Stephenson ..... G10D 7/14 984/137
2,591,023 A * 4/1952 Stephenson ..... G10D 7/14 84/403
3,580,125 A * 5/1971 Heatwole ..... G10D 7/14 984/137
4,237,766 A * 12/1980 Marshall ..... G10D 7/14 984/137
5,166,461 A * 11/1992 Salwitz ..... G10D 7/14 84/377
5,182,413 A * 1/1993 Epping ..... G10D 7/14 84/377
5,367,937 A * 11/1994 Epping ..... G10D 7/14 84/377
5,915,287 A * 6/1999 Fox ..... G10D 7/14 84/377
8,153,875 B1 * 4/2012 Beauregard ..... G10D 7/14 84/330
8,431,807 B1 * 4/2013 Beauregard, IV ..... G10D 9/00 84/377
2015/0179153 A1 * 6/2015 Okano ..... G10D 7/14 84/377

* cited by examiner

*Primary Examiner* — Robert W Horn

(57) ABSTRACT

A harmonica with a repeating major pentatonic scale configured across the draw reeds and a repeating major pentatonic scale a half step lower than the draw reeds configured across the blow reeds. This configuration produces a chromatic instrument where all the notes of a major pentatonic scale can be bent down to the next lower scale tone for musicality. It provides more notes and more bends when playing pentatonic scales and the repeating pattern facilitates easy learning.

1 Claim, No Drawings

ROCK BEND HARMONICA

CROSS-REFERENCE TO RELATED APPLICATIONS

This application claims the benefit of provisional patent application No. 63197823, filed Jun. 7, 2021 by the present inventor.

TECHNICAL FIELD

The present invention relates to the harmonica, and more particularly to its note arrangement, its "tuning".

BACKGROUND

The industry standard tuning often referred to as Richter (Table 1) was invented in the 1800's to play marching band music. In the early 20th century musicians found that by bending the reeds (drawing or blowing extra hard on the cavities) other notes could be accessed. People generally play in what is called cross harp now. You play in the key a fifth higher than the key of the harmonica. There are still six notes absent in Richter Tuning: F, F, G#, C, D#, and A#.

Bends better emulate the human voice. All pitches between the bendable note and the bent note(s) are attainable. Slide whistle like travel is possible. Unbendable notes are like a piano in that their pitch can't be varied.

The main chords used in playing contemporary music are the One, Four and Five chords (Roman numerals are often used for these "I-IV-V"). In C major C is the One (I) chord, F is the Four (IV) chord and G is the Five (V) chord. In C's relative minor key A minor, A minor is the One chord, D minor is the Four chord and E minor is the Five chord. A common way to play over these chord changes is to play a pentatonic scale (Table 2) of the same name over the given chord. Ex. C major pentatonic is played over the C chord, F major pentatonic is played over the F chord, G major pentatonic is played over the G chord, A minor pentatonic is played over the A minor chord, D minor pentatonic is played over the D minor chord, E minor pentatonic is played over the E minor chord.

A minor and C major pentatonic share the same notes. The difference is which note is used as home base, the tonic. D minor/F major share the same notes and E minor/G major also share the same notes. Thus, they are called relative major/minors.

Table 3 charts A minor pentatonic on Richter. The A in the lower octave can be bent down a whole step to G. The C is "static" in that it doesn't bend to or from another scale tone. Table 4 charts Richter D minor pentatonic which must be performed with blow bends. Blow bends are more difficult than draw bends. There is a D to C bend. The F is static. Table 5 charts E minor pentatonic on Richter. There is the A to G bend in the bottom octave and a static B.

TABLE 1

| Richter Tuning Key of D | | | | | | | | | | |
|---|---|---|---|---|---|---|---|---|---|---|
| | | | | | | | | | C | ← whole step blow bend |
| | | | | | | | F | $A_b$ | C# | ← half step blow bends |
| D | F# | A | D | F# | A | D | F# | A | D | |
| E | A | C# | E | G | B | C# | E | G | B | |
| $E_b$ | $A_b$ | C | Eb | | $B_b$ | | | | | ← half step draw bends |
| | G | B | | | | | | | | ← whole step draw bends |
| | | $B_b$ | | | | | | | | ← $1_{1/2}$ step draw bend |

TABLE 2

| | Half steps | | | | | | | | | | | |
|---|---|---|---|---|---|---|---|---|---|---|---|---|
| | \| | \| | \| | \| | \| | \| | \| | \| | \| | \| | \| | \| |
| Major Scale | 1 | | 2 | | 3 | 4 | | 5 | | 6 | | 7 |
| Major Pentatonic | | | | | | | | | | | | |
| Minor Pentatonic | | | | | | | | | | | | |
| Blues Scale | | | | | | | | | | | | |

TABLE 3

| Richter A minor pentatonic - A C D E G 10 notes | | | | | | | | | |
|---|---|---|---|---|---|---|---|---|---|
| D | | A | D | | A | | | | |
| E | A | | E | G | | | | | |
| | | C | | | | | | | |
| | G | | | | | | | | |

TABLE 4

| Richter D minor pentatonic - D F G A C 6 notes | | | | | | | | | |
|---|---|---|---|---|---|---|---|---|---|
| | | | | | | | | | C |
| | | | | | | F | | | |
| | | | | | D | | | A | D |
| | | | | | | | | G | |

TABLE 5

| Richter E minor pentatonic - E G A B D 17 notes | | | | | | | | | | |
|---|---|---|---|---|---|---|---|---|---|---|
| D | | A | D | | A | D | | A | D |
| E | A | | E | G | B | | E | G | B |
| | G | B | | | | | | | |

ADVANTAGES

Some advantages are to provide more notes of the pentatonic I, IV, and V scales, to provide more notes in general, to have more bends available and to provide an instrument that is easier to learn.

DETAILED DESCRIPTION

Rock Bend (Table 6) has a repeating pentatonic scale configured across the draw reeds. It has a repeating pentatonic scale a half step lower than the draw reeds configured across the blow reeds. The 5-hole repeating pattern facilitates ease of learning and musicality. This instrument is chromatic; all notes are present.

TABLE 6

| Rock Bend Tuning Key of C<br>Blow reeds - G# minor<br>Draw reeds - A minor | | | | | | | | | |
|---|---|---|---|---|---|---|---|---|---|
| F# | G# | B | C# | D# | F# | G# | B | C# | D# |
| A | C | D | E | G | A | C | D | E | G |
| G# | B | C# | D# | F# | G# | B | C# | D# | F# |
| G | A# | C | D | F | G | A# | C | D | F |
| | A | | | E | | A | | | E |

OPERATION

The blow reeds are a repeating G# minor pentatonic scale. The draw reeds play a repeating A minor pentatonic scale (A, C, D, E, G) and every hole can be bent down to the next lower scale tone providing the ability to bend to and from every scale tone of the pentatonic scale (Table 7). This creates a pleasing sound, mimicking the human voice. It makes it sing. Table 8 charts Rock Bend D minor pentatonic. Table 9 charts Rock Bend E minor pentatonic. Table 10 charts Rock Bend by scale degrees.

TABLE 7

| Rock Bend A minor pentatonic - A C D E G 20 notes | | | | | | | | | |
|---|---|---|---|---|---|---|---|---|---|
| A | C | D | E | G | A | C | D | E | G |
| G | | C | D | | G | | C | D | |
| | A | | | E | | A | | | E |

TABLE 8

| Rock Bend D minor pentatonic - D F G AC 18 notes | | | | | | | | | |
|---|---|---|---|---|---|---|---|---|---|
| A | C | D | | G | A | C | D | | G |
| G | | C | D | F | G | | C | D | F |
| | A | | | | | A | | | |

TABLE 9

| Rock Bend E minor pentatonic - E G A B D 20 notes | | | | | | | | | |
|---|---|---|---|---|---|---|---|---|---|
| | | B | | | | | B | | |
| A | | D | E | G | A | | D | E | G |
| | B | | | | | B | | | |
| G | | | D | | G | | | D | |
| | A | | | E | | A | | | E |

TABLE 10

| Rock Bend by scale degrees | | | | | | | | | |
|---|---|---|---|---|---|---|---|---|---|
| $5_b$ | $6_b$ | 7 | $2_b$ | $3_b$ | $5_b$ | $6_b$ | 7 | $2_b$ | $3_b$ |
| 6 | 1 | 2 | 3 | 5 | 6 | 1 | 2 | 3 | 5 |

CONCLUSION, RAMIFICATIONS, AND SCOPE

The reader will see this instrument provides the ability to bend to and from every note of the major pentatonic scale, making it sing. It has more notes and bends available for the I, IV, and V pentatonic scales. Being chromatic, it can play every scale conceivable. The 5-hole repeating pattern is easier to learn than a non-linear configuration.

Though the above examples are in a certain key with the tonic on a certain cavity/hole, this harmonica can be made in all keys and the tonic can be placed on any cavity.

I claim:

1. A harmonica comprising a body providing a series of adjacent cavities and a plurality of reeds each of which is responsive to the passage of air to produce a musical note of a predetermined pitch, two reeds being associated with each cavity such that one reed is the blow reed responsive to blowing on said cavity and the other is the draw reed responsive to drawing on said cavity, said harmonica being characterized in that:

(a) said draw reeds are constructed and arranged such that their predetermined pitches starting on a predetermined cavity produce the scale degrees 1, 2, 3, 5, 6, in a repeating pattern and (b) said blow reeds are constructed and arranged such that their predetermined pitches starting on said predetermined cavity produce the scale degrees 6b, 7, 2b, 3b, 5b in a repeating pattern.

* * * * *